US005887819A

United States Patent [19]

Korn et al.

[11] Patent Number: 5,887,819

[45] Date of Patent: Mar. 30, 1999

[54] WIRE OR TUBING SPOOL RACK WITH INTERCHANGEABLE SLIDE MEMBERS

[75] Inventors: Francis Korn, Durham; Robert Hall, Wallingford; Douglas Stender; George Forline, both of Durham, all of Conn.

[73] Assignee: The Durham Manufacturing Company, Durham, Conn.

[21] Appl. No.: 900,731

[22] Filed: Jul. 25, 1997

[51] Int. Cl.[6] ..... B65H 16/06

[52] U.S. Cl. ..... 242/594.3; 242/129.6; 242/598.3

[58] Field of Search ..... 242/594.3, 598, 242/598.3, 598.5, 129.6; 211/85.5

[56] References Cited

U.S. PATENT DOCUMENTS

| | | | |
|---|---|---|---|
| 492,975 | 3/1893 | Streeter | 242/598.3 |
| 2,841,343 | 7/1958 | Dorman | 242/129.6 |
| 3,854,509 | 12/1974 | Bailey | 242/594.3 |
| 3,856,230 | 12/1974 | Zimmer . | |
| 4,783,017 | 11/1988 | Ivitz, III et al. . | |

FOREIGN PATENT DOCUMENTS

| | | | |
|---|---|---|---|
| 1262766 | 4/1961 | France | 242/598.3 |
| 1307988 | 9/1962 | France | 242/594.3 |

*Primary Examiner*—John P. Darling
*Attorney, Agent, or Firm*—John H. Crozier

[57] ABSTRACT

A rack for dispensing material from a spool rotatingly mounted on a rod, the rack including: vertical left and right side members; structure to join the left and right side members; slots defined in the left and right side members to accept ends of the rod so as to support the rod in the rack; and the left and right side members being symmetrical such that the left and right side members are interchangeable.

7 Claims, 4 Drawing Sheets

WIRE OR TUBING SPOOL RACK WITH INTERCHANGEABLE SLIDE MEMBERS

BACKGROUND OF THE INVENTION

1. Field of the Invention

The present invention relates to wire or tubing spool racks generally and, more particularly, but not by way of limitation, to a novel wire or tubing spool rack which has symmetrical side members such that the side members are interchangeable.

2. Background Art

Wire or tubing spool racks hold one or more horizontal rods extending between side members, each rod having rotatingly mounted thereon one or more spools of wire or tubing. Material is dispensed from a spool by pulling the free end of the material until a desired length of the material has been dispensed. Originally, one side of the rack had a downwardly sloped slot defined therein and the other side had an opposing hole defined therein. This arrangement permitted a person to lift the rod up and out of the slot and slide the spool(s) off the rod. This procedure was reversed to refill the rod. An improvement on this arrangement was to provide slots on both side members to that the user had the option of removing the rod up and out at either end of the rod. Either of these arrangements meant that there were "left" and "right" side members to the rack, which could result in warranty claims when two "lefts" or two "rights" were furnished to the customer.

A further disadvantage of conventional wire or tubing spool racks is that the slots formed therein are arranged such that the rods may be inadvertently pulled out of the racks when wire or tubing is being pulled from a spool.

Accordingly, it is a principal object of the present invention to provide a wire or tubing spool rack that has identical "left" and "right" side members such that the side members are interchangeable.

It is an further object of the invention to provide a wire or tubing spool rack that minimizes the possibility that rods therein may be inadvertently pulled from the rack when wire or tubing is dispensed therefrom.

It is an additional object of the invention to provide such a wire or tubing spool rack that is economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a rack for dispensing material from a spool rotatingly mounted on a rod, said rack comprising: vertical left and right side members; means to join said left and right side members; slots defined in said left and right side members to accept ends of said rod so as to support said rod in said rack; and said left and right side members being symmetrical such that said left and right side members are interchangeable.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
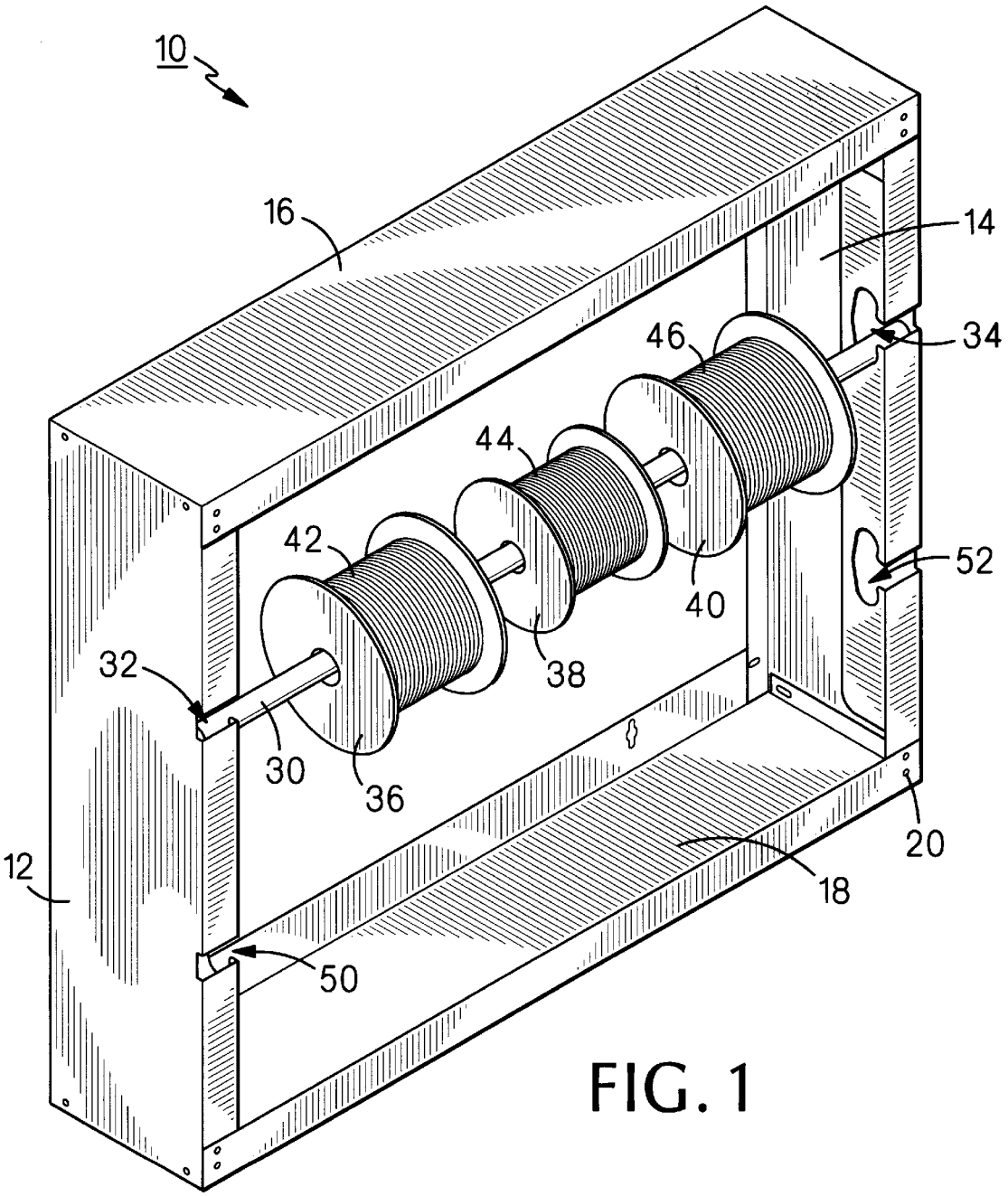
FIG. 1 is an isometric view of an assembled wire or tubing spool rack with a rod having spools of wire or tubing thereon mounted therein, constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a wire or tubing spool rack constructed according to the present invention and generally indicated by the reference numeral 10. Rack 10 includes a left side member 12, a right side member 14, a top member 16 and a bottom member 18. Ends of adjacent such members are joined, as at 20, by suitable conventional fasteners.

Rack 10 has mounted therein a rod 30 the ends of which are disposed in a slot 32 defined in left side member 12 and a slot 34 defined in right side member 14. Rotatingly mounted on rod 30 are spools 36, 38, and 40 on which are coiled, respectively, wire or tubing 42, 44, and 46. In the conventional manner, wire or tubing 42, 44, and 46 are dispensed from rack 10 by pulling free ends of the wire or tubing until a desired length has been dispensed. It will be understood that more than one rod may be similarly mounted in rack 10 and that more or less than three spools may be mounted on the rod(s). The embodiment shown also includes a second slot 50 defined in left side member 12 and a second slot 52 defined in right side member 14, although no rod is shown as extending therebetween.

Figure 2:
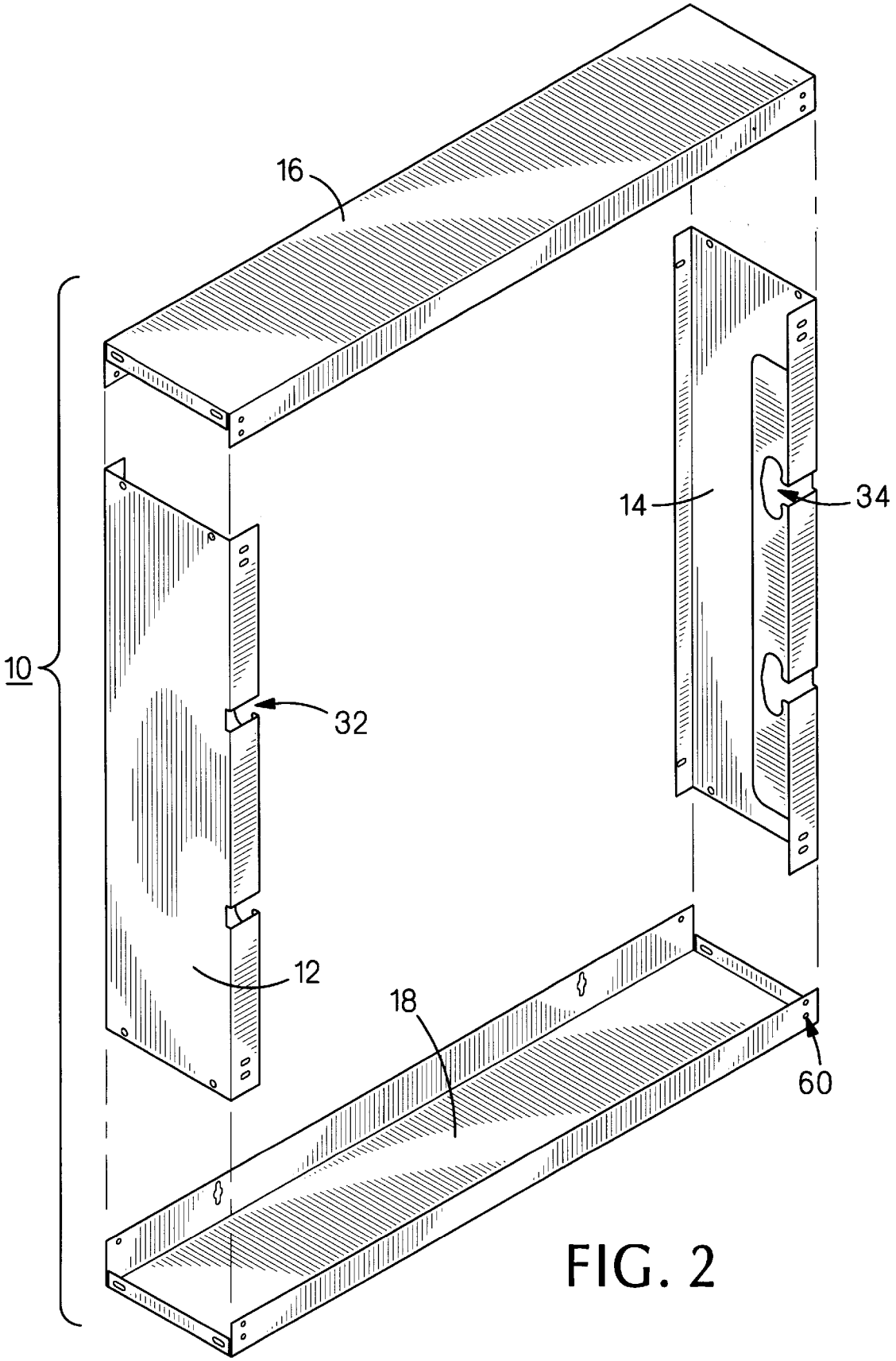
FIG. 2 is an exploded isometric view of the wire or tubing spool rack.
Figures 3, 4:
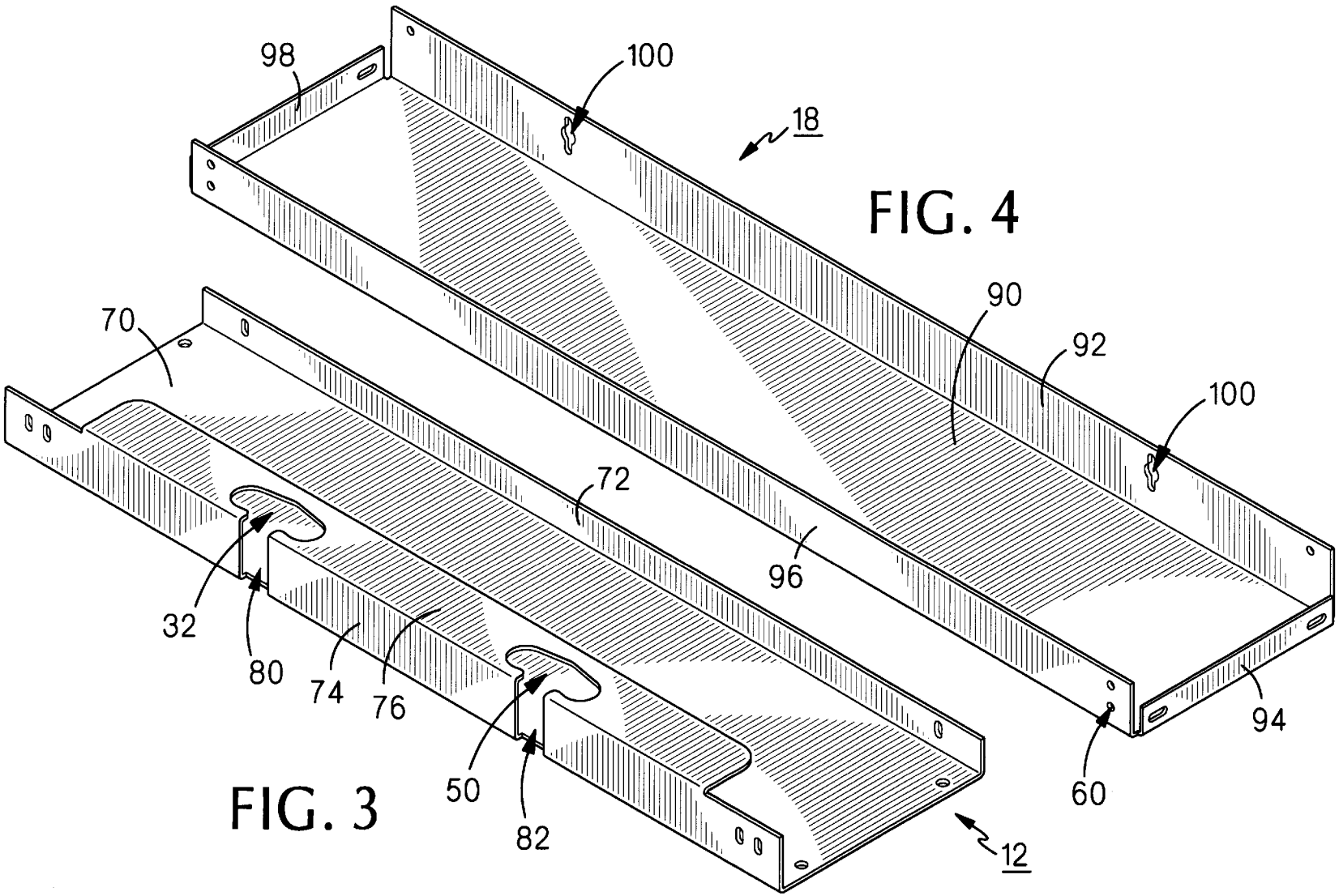
FIG. 3 is an isometric view of a side member of the wire or tubing spool rack.
FIG. 4 is an isometric view of a bottom member of the wire or tubing spool rack.

FIG. 2 illustrates rack 10 in an unassembled state and further illustrates a plurality of holes, as at 60, through which fasteners 20 (FIG. 1) may extend to assemble rack 10. With reference additionally to FIGS. 3 and 4, it will be understood that left side 12 member and left side 14 member are identical and interchangeable. Thus, only one side member part need be stocked for rack 10 and there is no possibility that a customer would receive two "left" or two "right" side members for a rack. Additionally, top member 16 and bottom member 18 are identical so that only one part need be stocked for both the top and bottom members, thus providing further economy.

Referring now to FIG. 3, the construction of left side member 12 is shown more clearly. As indicated above, it will be understood that, except for the reference numerals, right side member 14 is identical to left side member 12. Left side member 12 includes a planar, rectangular central portion 70 having an assembly and reinforcing flange 72 extending inwardly along the length of the rear edge of the central portion and orthogonally thereto. A front flange 74 extends inwardly along the length of the front edge of central portion 70 orthogonally thereto. A slot flange 76 extends along nearly the length of front flange 74 and is parallel to central portion 70. Slots 32 and 50 are defined in slot flange 76 and access openings 80 and 82 are defined in front flange 74 to permit the ends of rod 30 (FIG. 1) to be inserted, respectively, through the access openings and thence into slots 32 and 50.

FIG. 4 illustrates more clearly the construction of bottom member 18. As indicated above, it will be understood that the construction of top member 16 is identical to that of bottom member 18. Bottom member 18 includes a planar, rectangular central portion 90 having assembly and reinforcing flanges 92, 94, 96, and 98 orthogonal to the central portion and extending upwardly, respectively, along the lengths of the rear, right side, front, and left side edges of the central portion. Also shown are keyhole slots 100 to facilitate the mounting of rack 10 (FIG. 1) to a wall or other such surface.

Figure 5:
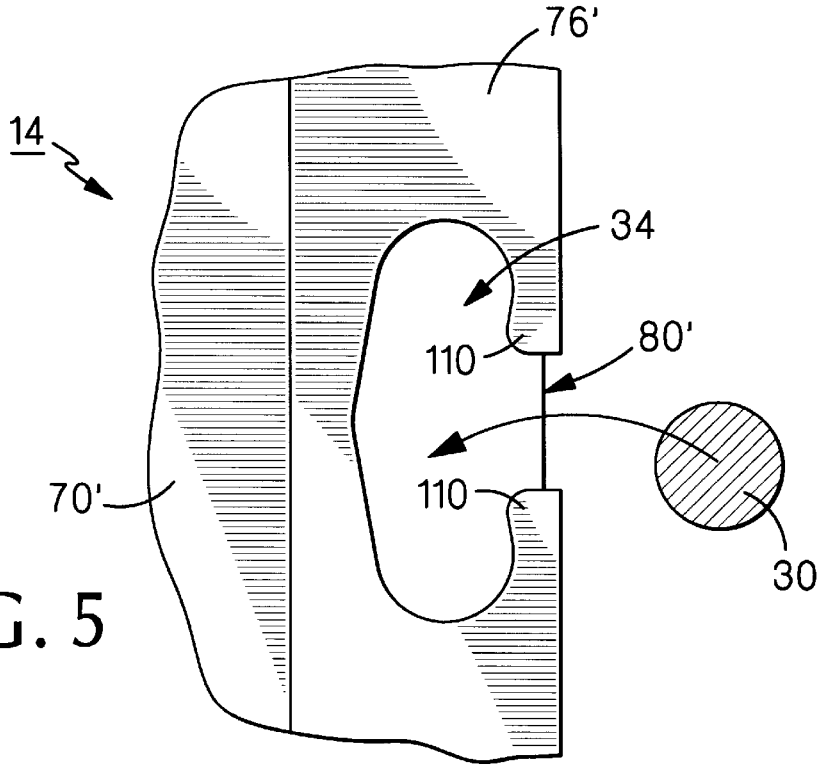
FIG. 5 a fragmentary side elevational view, partially in cross-section, showing a rod being placed in the slot of a side member of the wire or tubing spool rack.

FIG. 5 illustrates a portion of right side member 14, the primed reference numerals having the same function as similar reference numerals with respect to left side member 12 (FIG. 3). FIG. 5 shows, in part, the end of rod 30 about to be inserted into access opening 80' and thence into slot 34. Inspection of slot 34 shows that the slot is double-lobed and symmetrical about a central horizontal axis which permits a side member part to be used either as a "left" side or a "right" side. An important feature of slot 34 is that the lobes are canted forwardly such that rearwardly facing lips 110 are formed at either end of access opening 80'. This feature helps hold rod 30 in place in slot 34 and minimizes the possibility that the rod will be pulled out of the slot as wire or tubing 42, 44, and 46 (FIG. 1) is dispensed from rack 10.

Figures 6, 7:
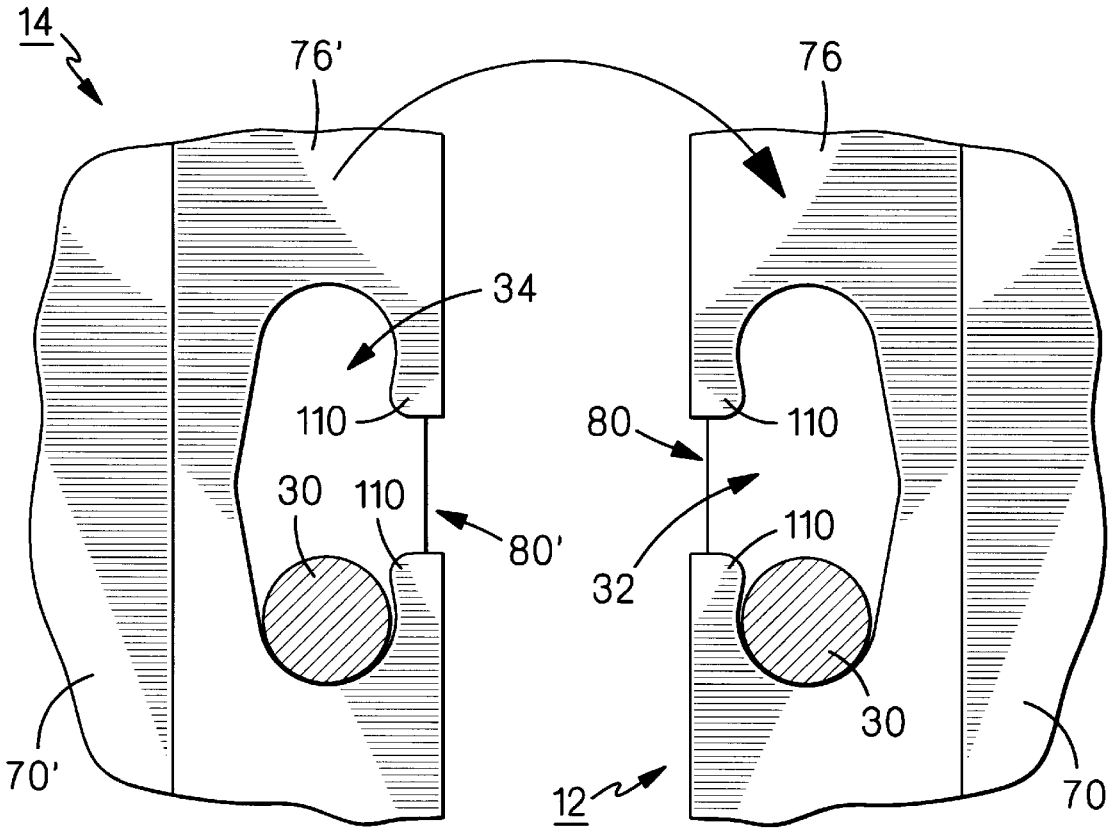
FIGS. 6 and 7 fragmentary side elevational views, partially in cross-section, showing the symmetry of the side members of the wire or tubing spool rack, with a rod seated therein.

FIG. 6 is the same as FIG. 5, with rod 30 seated in slot 34 and FIG. 7 is presented to show a similar portion of left side member and further illustrate the symmetry of the design of the present invention.

Rack 10 may be economically constructed of any suitable metallic material using blanking and bending techniques or it may be constructed of any other suitable material using techniques known in the art.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A rack for dispensing material from a spool rotatingly mounted on a rod, said rack comprising:

(a) vertical left and right side members;

(b) means to join said left and right side members;

(c) access openings defined in said left and right side members, each of said access openings having slots extending upwardly and downwardly from said each of said access openings to accept an end of said rod so as to support said rod in said rack;

(d) said left and right side members being symmetrical such that said left and right side members are interchangeable;

(e) each of said left and right side members including a generally planar, vertical central portion;

(f) a first flange extending inwardly along a front edge of said central portion and orthogonal thereto;

(g) a second flange extending along an edge of said first flange and parallel to said central portion, with at least one of said slots defined in said second flange; and (h) said each of said access openings being defined in a said first flange adjacent said at least one of said slots such that an end of said rod may be inserted through said access opening and into said at least one of said slots.

2. A rack for dispensing material, as defined in claim 1, wherein: said means to join comprises symmetrical, horizontal top and bottom members such that said top and bottom members are interchangeable.

3. A rack for dispensing material, as defined in claim 1, wherein: said upwardly and downwardly extending slots comprise lobes canted forwardly such as to form inwardly facing lips on either side of said access opening such as to minimize possibility of said rod being pulled from said at least one of said slots as said material is dispensed from said rack.

4. A rack for dispensing material from a spool rotatingly mounted on a rod, said rack comprising:

(a) vertical left and right side members;

(b) means to join said left and right side members;

(c) access openings defined in said left and right side members to accept ends of said rod so as to support said rod in said rack;

(d) each of said access openings having slots extending upwardly and downwardly from each of said access openings; and (e) said upwardly and downwardly extending slots including lobes canted forwardly such as to form inwardly facing lips on either side of said access opening such as to minimize possibility of said rod being pulled from said at least one of said slots as said material is dispensed from said rack.

5. A rack for dispensing material, as defined in claim 4, further comprising:

(a) each of said left and right side members including a generally planar, vertical central portion;

(b) a first flange extending inwardly along a front edge of said central portion and orthogonal thereto;

(c) a second flange extending along an edge of said first flange and parallel to said central portion, with at least one of said slots defined in said second flange; and (d) said access opening is defined in said first flange.

6. A rack for dispensing material, as defined in claim 4, wherein: said means to join comprises symmetrical, horizontal top and bottom members such that said top and bottom members are interchangeable.

7. A rack for dispensing material, as defined in claim 4, wherein: said left and right side members are symmetrical such that said left and right side members are interchangeable.

* * * * *

UNITED STATES PATENT AND TRADEMARK OFFICE

CERTIFICATE OF CORRECTION

PATENT NO. : 5,887,819

DATED : March 30, 1999

INVENTOR(S) : Francis Korn et al.

It is certified that error appears in the above-identified patent and that said Letters Patent is hereby corrected as shown below:

On the title page, [54]Title, should be
--WIRE OR TUBING SPOOL WITH INTERCHANGEABLE SIDE MEMBERS--

Signed and Sealed this

Thirteenth Day of July, 1999

*Attest:*

*Attesting Officer*

Q. TODD DICKINSON

*Acting Commissioner of Patents and Trademarks*